US012534856B2

(12) United States Patent
Goess et al.

(10) Patent No.: US 12,534,856 B2
(45) Date of Patent: Jan. 27, 2026

(54) PACKAGING PAPER

(71) Applicant: Mondi AG, Vienna (AT)

(72) Inventors: Paulus Goess, Klagenfurt (AT); Elisabeth Schwaiger, Vienna (AT)

(73) Assignee: Mondi AG, Vienna (AT)

( * ) Notice: Subject to any disclaimer, the term of this patent is extended or adjusted under 35 U.S.C. 154(b) by 222 days.

(21) Appl. No.: 18/552,944

(22) PCT Filed: Mar. 30, 2022

(86) PCT No.: PCT/EP2022/058495
§ 371 (c)(1),
(2) Date: Sep. 28, 2023

(87) PCT Pub. No.: WO2022/207756
PCT Pub. Date: Oct. 6, 2022

(65) Prior Publication Data

US 2025/0270768 A1 Aug. 28, 2025

(30) Foreign Application Priority Data

Mar. 31, 2021 (EP) ..... 21166361

(51) Int. Cl.
*D21H 27/10* (2006.01)
*D21C 9/10* (2006.01)
*D21H 17/67* (2006.01)

(52) U.S. Cl.
CPC ..... *D21H 27/10* (2013.01); *D21C 9/10* (2013.01); *D21H 17/67* (2013.01)

(58) Field of Classification Search
None
See application file for complete search history.

(56) References Cited

U.S. PATENT DOCUMENTS

2024/0359840 A1* 10/2024 Goodrich ..... B31D 3/04

FOREIGN PATENT DOCUMENTS

| | | | |
|---|---|---|---|
| EP | 3168362 | 5/2017 | |
| EP | 3202979 | 8/2017 | |
| EP | 3633104 | 4/2020 | |
| EP | 3023543 B1 * | 9/2020 | ..... D21H 27/00 |
| JP | 2007262603 | 10/2007 | |
| WO | 2020/120535 | 6/2020 | |

OTHER PUBLICATIONS

International Search Report.

* cited by examiner

*Primary Examiner* — Yan Lan
(74) *Attorney, Agent, or Firm* — Dunlap Bennett & Ludwig PLLC

(57) ABSTRACT

A packaging paper for sharp-edged objects and/or objects having unevenly arranged, protruding, substantially non-deformable elevations on at least one of the surfaces of the object, consisting of kraft pulp as the main constituent and fillers, starch, sizing agent and additional process aids. The packaging paper containing at least 95% primary pulp having a length-weighted average fiber length of at least 2.0 mm and cationic starch and other process aids. The packaging paper has an elongation at break in the machine direction (MD) according to ISO 1924-3:2005 of at least 6.0%, a puncture energy index according to DIN EN 14477: 2004 at a test speed of 10.0 mm/min, measured on any side of the packaging paper, in the range of 30 to 75 $mJ \cdot m^2/kg$ and a kappa number according to ISO 302:2015 of between 35 and 38.

10 Claims, No Drawings

PACKAGING PAPER

BACKGROUND OF THE INVENTION

The present invention relates to a packaging paper for sharp-edged objects and/or objects which have non-uniformly arranged, protruding, substantially non-deformable elevations on at least one of its surfaces, which consists of kraft pulp as the main constituent as well as fillers, starch, sizing agents and further process adjuvants as well as optionally bleaching agents and/or coating agents.

Packaging materials made of paper and card are used extensively throughout the world for the most diverse objects or materials in order to provide, on the one hand, recyclable packaging materials and on the other hand, to reduce as far as possible or avoid the amount of waste materials which do not rot down. For this reason, over the last few years paper is also being increasingly used in areas in which exclusively plastics and plastic composite materials had been used as packaging materials only a few years ago, wherein in these areas of use, frequently more attention must be paid to the respective requirements such as weight of the packaged items, possible fat and/or moisture contents, external shape of the packaged items as well as the stability of the packaged items with respect to pressure, temperature loading and the like so that it is necessary to provide specially produced or treated papers. Thus, it is known to use paper for packaging building materials such as sand, cement or even stones, also for packaging consumer goods, in particular also for foodstuffs such as flour, rice, noodles, nuts and more of the like. Another area of use of paper is the packaging of consumer goods such as toys, garments, electronic components, household goods, screws or nails and many others as well as, for example, as open packagings such as bags or carrier bags.

Here packaging papers must satisfy the respective requirements of the product to be packaged therein, in particular they must have sufficient tear strength, elasticity, air permeability and the like. On the other hand, for example, it is a requirement for a packaging paper which is used for the packaging of moisture-sensitive materials that it has a sufficient moisture resistance and in particular a barrier property with respect to moisture or has only a very limited moisture permeability. Which specific properties a packaging paper must have for the respective planned usage can be estimated and determined by a person skilled in the art, wherein the composition, the method of manufacture, possible or necessary treatment steps and materials can be estimated at least roughly by a person skilled in the art but the manufacture of a paper satisfying all these requirements must take into account a multiplicity of factors which frequently also interact with one another so that a final composition of the packaging paper and its manufacture usually requires many attempts and unsuccessful attempts. Problems with the use of paper as packaging material frequently arise when sharp-edged objects must be packaged or objects must be packaged which have surface regions with more or less large projections, jags, edges, corners or the like. Here paper can only be used to a limited extent since on the one hand, it can be abraded at the uneven locations and as a result of destruction or tearing of the structure of the paper, it can lose a good proportion of its positive properties such as strength and the like. Another possible risk is that the packaging paper tears as a result of contact with the sharp edges or points of the objects packaged therein and as a result, the objects packaged therein can either be lost, damaged or their quality can be reduced since an undamaged packaging no longer exists. In order to avoid such tearing of packaging paper, it has frequently been the case in the past that this has been coated at least on one side with plastic films, polymers or other tear-resistant and at the same time elastic materials or an insert of such materials was introduced into multilayer papers in order to be able to use paper as packaging material for sharp-edged objects or objects having an uneven surface.

As a result of the fact that non-rottable polymers or plastic materials should be avoided as far as possible, there is a need for packaging materials made of paper which on the one hand, are sufficiently elastic, stretchable and flexible in order not to tear under corresponding stresses and on the other hand, when sharp-edge objects are packaged therein, in order to be able to prevent any destruction or damage to the packaging such as piercing, abrasion or tearing by the objects packaged therein.

SUMMARY OF THE INVENTION

The aim of the present invention is to provide such a packaging paper by means of which it is possible to package the most diverse sharp-edged objects or materials or those having an irregular surface without this resulting in penetration of the packaged object by the packaging paper or tearing of the same.

In order to achieve this object, the packaging paper according to the invention is substantially characterized in that it contains at least 95% primary pulp containing at least 80%, preferably at least 90%, in particular at least 95% pulp having an average length-weighted fibre length of at least 2.0 mm as well as less than 4.5%, preferably less than 4.0%, in particular less than 3.7% fillers as well as cationic starch and other process adjuvants, that it has a strain at break in the machine direction (MD) according to ISO 1924-3:2005 of at least 6.0%, preferably at least 6.5%, that it has a puncture energy index according to DIN EN 14477:2004 measured at a test speed of 10.0 mm/min on an arbitrary side of the packaging paper in the range of 30 to 75 $mJ \cdot m^2/kg$, preferably 35 to 70 $mJ \cdot m^2/kg$ and that it has a Kappa number ISO 302:2015 between 35 and 58, preferably 39 and 48. Since the packaging paper contains at least 95% primary pulp, it is ensured that the packaging paper is a paper having the highest quality and best properties since a person skilled in the art is aware that the possible admixture of recycling pulp can disadvantageously influence the paper quality and in particular, there can be a deterioration in the strength properties and the elasticity properties of the paper. Surprisingly it has been found that a possible admixture of secondary pulp in the order of magnitude of up to a maximum of 5% does not disadvantageously influence the strength and elasticity of the paper. The proportion of primary pulp should optionally be adapted and, for example, increased depending on the food safety requirements for the packaging material in the packaging task and depending on the condition of the foodstuff to be packaged, for example, such as, for example, dry, moist and/or greasy. Alternatively, accompanying corresponding analyses can be carried out on the packaging material in order to achieve and ensure the food safety requirements in the long term but this is associated with a considerable increased expenditure of resources such as, for example, chemical detection reagents and necessary analytical equipment. Since the packaging paper has a Kappa number in accordance with ISO 302:2015 between 35 and 58, preferably 39 and 48, it is ensured that the use of bleaching chemicals can be dispensed with and thus the packaging paper can be used in an advantageous manner in the foodstuffs area. Furthermore, a pulp having a Kappa number in accordance with ISO 302:2015 between 35 and 58, i.e. unbleached pulp, can bind more starch than a bleached pulp fibre. Moreover, by using cationic starch, the dry strength of the paper mixed therewith is increased which is why, in particular when using an unbleached pulp for the manufacture of packaging paper, the aim is to use starch contents of more than 12 kg/to paper atro (atro means absolutely dry). With such a packaging paper in a surprising manner a suitable packaging paper can be successfully provided for the requirements for use in the foodstuffs area and also in particular a packaging paper is successfully obtained which in addition has excellent strength and elasticity properties.

It is known that the bleaching of paper removes concomitant substances and is used in particular when the surface of the paper must be printed, for example, since bleached papers are usually more easily printed, since a better printing ink brilliance is possible. However, it should be noted in connection with the present invention that the packaging paper is used as unbleached packaging paper for which pulps having Kappa numbers according to ISO 302:2015 in the range of 35 or higher have been used for the manufacture thereof.

According to a further development of the invention, the packaging paper is configured so that it contains 100% primary pulp. Even though an admixture of secondary pulp in the order of magnitude of up to a maximum of 5% does not disadvantageously influence the strength and elasticity of the paper, by using 100% primary pulp it can be ensured that the packaging paper is suitable for the packaging of foodstuffs having a non-uniform uneven surface such as noodles, muesli bars, nuts or the like.

With such packaging papers, single- or multilayer packaging papers are successfully provided according to the grammage of the respective paper, which for example can serve as a replacement for plastic packagings or packaging board.

In the present case, when the term "fillers" is used, it is considered that this term also encompasses the ash content located in the paper itself. This is because the ash quantities present in the paper normally do not exceed 0.5%.

When % information is given within the scope of the present invention, weight percent in relation to dry mass is meant unless something different is noted.

Since furthermore the primary pulp used consists of a mixture consists of at least 80% soft wood pulp, preferably at least 90% soft wood pulp, in particular at least 95% with an average length-weighted fibre length according to ISO 16065-2:2014 of at least 2.1 mm as well as remainder hard wood pulp having an average length-weighted fibre length according to ISO 16065-2:2014 of at least 1.0 mm, in particular the strength and elasticity properties of the packaging paper produced therewith are successfully influenced in the direction of a higher elasticity of the packaging paper and any premature tearing of the packaging paper produced according to the invention when it comes in contact with sharp-edged objects is successfully impeded.

By limiting the quantity, type of application, processing and the like of the paper adjuvants such as, for example, filler content, the cationic starch or the sizing agent, in particular to sizing agent processed at a neutral pH to values of less than 4.5%, packaging paper produced exclusively from primary pulp can be substantially successfully provided which not only has excellent mechanical properties but in particular, as a result of the small quantities of additionally used additives or fillers, is suitable for special usage purposes such as foodstuff packagings and the like and also may be used as such. Such a packaging paper which substantially consists exclusively of primary pulp primarily selected from coniferous fibres which optionally contain or have mixed in small quantities of hardwood fibres, and which contain small quantities of fillers and starch, as a result of a special treatment, in particular by grinding the pulp fibres and optionally further process steps such as a treatment of the paper web on a Clupak system, a calendering and the like, achieves a strain at break in the machine direction according to ISO 1924-3:2005 of at least 6.0%. As an example for suitable primary pulps, mention may be made of, inter alia, long-fibre pulp comprising one coniferous species or several, short-fibre pulp comprising one hard wood species or several as well as mixtures comprising the said pulps. Preferably the pulps are produced according to the kraft sulphate method. Such a packaging paper furthermore has a puncture energy index in accordance with DIN EN 14477:2004 with a test speed of 10.0 mm/min measured on an arbitrary side of the packaging paper in the range of 30 to 75 $mJ \cdot m^2/kg$, which means that when such a paper is used for packaging sharp-edged objects and/or objects having non-uniformly arranged, protruding and substantially non-deformable elevations on at least one of its surfaces, any puncturing or piercing of the sharp-edged objects through the paper can be impeded. It is surprising here that a packaging paper having a strain at break of over 6.0% at the same time also has the highest values for the puncture energy index and thus disadvantageous effects which, for example, accompany very high strain values such as, for example, a very strong roughening of the paper surface, can be reduced. With such a packaging paper, restrictions in the printability can thus be successfully impeded. Since furthermore, a too-high strain is at the expense of the tensile strength, an optimally balanced paper and both in relation to the strain and also to the strength is provided with the packaging paper. Thus, a packaging paper according to the invention can now be used safely and without the risk of losses of items packaged therein as a result of abrasion by protruding areas of the items packaged therein, for the packaging of such sharp-edged items as, for example, gravel, pellets, metal parts such as screws, garments with buttons, shoes with sharp heels, children's play bricks and also foodstuffs such as muesli bars, chocolate-nut bars, nuts, noodles and the like.

Puncture energy, which is defined in DIN EN 14477:2004, is understood as the force taking into account a strain which must be applied to puncture a paper or a board with a defined test specimen. For a packaging paper which is to be used for the packaging of sharp-edged objects, it is therefore essential that its puncture energy is high, that it cannot be punctured by objects or parts of the objects packaged therein. Furthermore, it is important that a packaging, in particular during transport, is not damaged by a penetration of objects packaged inside thereof likewise during the handling of the same. The puncture energy index, that is the puncture energy of a paper divided by its grammage, was measured in connection with the present invention using the standard DIN EN 14477:2004, which standard is usually used to determine the puncture energy of flexible packaging materials such as, for example, plastic films. In addition to the puncture strength in Newtons, the strain at puncture in mm is however also crucial for non-damage to the packaging. The integral below a force-strain curve gives the energy which a material, and according to the present invention, a packaging paper can absorb without this resulting in damage to the same. In order to determine the puncture energy index in $mJ \cdot m^2/kg$, the determined puncture energy in mJ is divided by the grammage according to ISO 536:2019 of the respective paper converted into $kg/m^2$. The calculation of the puncture energy index is made by analogy with the calculation of the tensile fracture work index in accordance with ISO 1924-3:2005.

In the present context, an average length-weighted fibre length in accordance with ISO 16065-2:2014 of the pulp fibre is understood to be a length-weighted average of the fibre lengths.

A starch which has been subjected to a cationization treatment with bases such as NaOH, KOH, calcium carbonate and a cationizing agent such as, for example, 2,3-epoxypropyl-trimethyl-ammonium chloride and which has a degree of cationization, i.e. a fraction of cationic charges in the range of 0.02 to about 0.06 is designated as cationic starch as is known to the person skilled in the art.

Soft wood pulp is understood as a pulp which was produced from a soft wood, i.e. a wood having a Darr density below 0.55 $g/cm^3$. Examples of such soft woods are substantially almost all coniferous woods such as spruce, larch, fir, pine and Douglas fir but also deciduous woods such as willow, poplar or lime. Hard wood pulp is understood as a pulp which was produced from a hard wood, that is woods having a Darr density of over 0.55 $g/m^3$. Representatives of hard woods are, for example, beech, oak, ash and birch, poplar, aspen, maple and acacia. The fibre length of the fibres contained therein can be used as a further distinguishing feature between hard and soft wood, wherein this fibre length is influenced not only by the type of wood but also by the age of the tree and the position of the fibres in the cross-section of the tree trunk. According to the invention, substantially soft woods having a length-weighted average fibre length of at least 2.1 mm and optionally hard woods having a length-weighted average fibre length of at least 1.0 mm are used. This length-weighted fibre length of a pulp fibre is defined in ISO 16065-2:2014 and is determined according to this standard.

In order to obtain a packaging paper with particularly good properties and in particular to eliminate that constituents which cannot be defined in detail such as, for example, residues of printer inks, surface treatment agents or the like are introduced into the paper, the packaging paper according to the invention is further developed in that it contains 100% primary pulp. If it is ensured that apart from primary pulp, in particular no recycled pulp is contained in the paper, a packaging paper having exactly reproducible properties can be obtained. Furthermore, packaging papers which exclusively consist of primary pulp can be used as packaging paper for foodstuffs.

According to a further development of the invention, the packaging paper is substantially characterized in that the primary pulp is formed from a mixture consisting of at least 80% soft wood pulp, preferably at least 90% soft wood pulp, in particular at least 95% soft wood pulp with an average length-weighted fibre length according to ISO 16065-2:2014 of at least 2.1 mm and the remainder hard wood pulp having an average length-weighted fibre length according to ISO 16065-2:2014 of at least 1.0 mm. By selecting the corresponding primary pulp or a corresponding mixture of primary pulps, not only the properties of the packaging paper such as, for example, its strain at break and its puncture energy index can be successfully influenced but other properties important for packaging papers such as strength of the paper, tensile strength of the same, air permeability and the like can also be successfully influenced.

Favourable values were achieved here when, as corresponds to a further development of the invention, the packaging paper is configured so that the primary pulp consists of 100% soft wood pulp having an average length-weighted fibre length according to ISO 16065-2:2014 of at least 2.1 mm. It should be noted in this context that compared with papers which comprise hard wood constituents or are exclusively fabricated from hard wood pulp, the packaging paper which is fabricated from 100% soft wood pulp having an average length-weighted fibre length according to ISO 16065-2:2014 of at least 2.1 mm are thinner, have a good strength and are also printable but on the other hand, for example, higher hard wood constituents make the paper more uniform in the leaf structure and the attainable printing quality can also be improved.

The packaging paper according to the present invention favourably here has a grammage in accordance with ISO 536:2019 of 45 $g/m^2$ to 165 $g/m^2$, preferably 50 $g/m^2$ to 160 $g/m^2$. It has been shown in the course of experiments that this wide range of grammages can be ensured in particular by adjusting the fillers which are added to the pulp and the grinding energy used. Here it has been shown, for example, that the content of cationic starch must be kept low when papers having grammages in the range of 50 $g/m^2$ to 70 $g/m^2$ and a puncture energy index in accordance with DIN EN 14477:2004 in the range of 30 $mJ \cdot m^2/kg$ to 75 $mJ \cdot m^2/kg$ are to be produced.

According to a further development of the invention, the packaging paper is configured so that it has a tensile strength index in the machine direction in accordance with ISO 1924-3:2005 between 60 and 140 Nm/g. Such tensile strength indices can be achieved in the packaging papers according to the invention as a result of the low filler content in the paper, wherein when using fillers, care must be taken to ensure that when the paper is intended for use in the foodstuffs area, these are permitted for this. In this context, attention should specially be paid to grain sizes in the micro- and nanometre range.

When using the packaging paper in all other areas not relating to foodstuffs packaging, the selection of the filler is less critical but the filler content should be kept low in principle in order to achieve the desired tensile strength index in the machine direction between 60 Nm/g and 140 Nm/g. As a further adjuvant for adjusting strength properties, mention may be made, for example, of derivatized starch, preferably cationic starch. In general, in the case of all additives used in the paper manufacturing process, attention must be paid to the suitability as an input material for the manufacture of foodstuff packaging papers.

According to a further development of the invention, the packaging paper is configured so that the primary pulp is contained as a ground, in particular high-consistency ground pulp having a Schopper-Riegler degree of grinding in accordance with ISO 5267-1:1999 between 13° SR to 20° SR. Grinding of pulp influences the fibre thickness or strength and thus raises the quality of the product thus produced from several aspects. In particular, when using non-bleached, i.e. unbleached (i.e. natural brown) pulp, the paper quality can be influenced in that residual wood chips contained in the pulp and fibre clumps not macerated by boiling the pulp are finely ground during the high-consistency grinding and thus the texture of the made more uniform and in particular smoothed. By providing a ground, in particular high-consistency ground pulp having a Schopper-Riegler degree of grinding in accordance with ISO 5267-1:1999 between 13° SR to 20° SR as primary pulp according to the invention, the puncture energy can be successfully further increased. In this context, it is not necessary to note that naturally the pulp can also be additionally low-consistency ground. A low-consistency grinding is carried out with a consistency of the pulp suspension between 2% to 6% wherein a further increase in strength and therefore also increase in the puncture energy can be achieved through this step.

On the one hand, with reference to the objects packaged therein, packaging papers must be sufficiently dense in order to avoid any loss in the case of powdery materials or to reduce any water absorption of hygroscopic items packaged therein according to the application and on the other hand, they must have a sufficient air permeability so that air introduced during filling for example can escape through the packaging paper itself. In order to meet these requirements, according to a further development of the invention, the packaging paper has a Gurley value in accordance with ISO 5636-5:2013 between 5 s and 45 s, in particular 10 s and 40 s.

Depending on the planned usage purpose of the packaging paper, according to a further development this can be configured so that at least one side of the packaging paper is surface-treated, in particular smoothed and/or coated. With such a surface treatment, the moisture barrier property, for example, can be influenced but also in particular the puncture energy can be further improved so that the paper can withstand even stronger stresses, in particular with respect to uneven or pointed objects packaged in the paper.

Surface finishing is understood as meaning the treatment of at least one side of the packaging paper with at least one of the following methods: application of a coating material and smoothing or calendaring the paper surface.

According to a further development of the invention, the packaging paper is configured so that the puncture energy index in accordance with DIN EN 14477:2004 between a surface-treated side of the packaging paper and an untreated side of the packaging paper differs by a factor greater than 1.0 to1.7 or by a factor less than 1.0 to 1.7. The puncture energy index is usually influenced by executing steps for surface treatment such as, for example, introducing functional barrier coatings. So that it can now be ensured that such a packaging paper has all the properties required for the packaging of goods having sharp-edged or irregular surfaces, it is important on the one hand to ensure properties such as printability of a surface and on the other hand, to ensure that the second surface which for example comes in contact with foodstuffs having an irregular surface still has a sufficient puncture energy index which is why a corresponding factor which differs only slightly from 1.0 should be formed during the paper production and in particular during the surface treatment. However, the puncture energy index should preferably be seen as an inherent paper property and not or only slightly dependent on the surface treatment.

A corresponding surface treatment is particularly advantageous and expedient when one side of the paper comes in contact with sharp-edged objects and the other should be printed or described, for example, in which case the two surfaces of the packaging paper must be subjected to different refining treatments.

The invention will be explained in detail hereinafter with reference to exemplary embodiments.

DETAILED DESCRIPTION OF THE INVENTION

Example 1: Manufacture of a Packaging Paper Having a Grammage of 50 g/m$^2$

Description of the Process:

An unbleached pulp was used consisting of 95% primary pulp made of soft wood having a Kappa number of 42 and 5% primary pulp made of hard wood having a Kappa number of 40 which is firstly subjected to a high-consistency grinding with a grinding power of 190 to 210 kWh/to, wherein a degree of grinding of the pulp after a high-consistency grinding was 17° SR and then this pulp was subjected to a low-consistency grinding of 75 kWh/to until a degree of grinding of at least 18° SR was achieved. Adjuvants are added in the constant part of the paper machine. In this case, the pH was adjusted with aluminium sulphate to a pH of 6.5 to 7.5, cationic starch having a degree of cationization DS of 0.05 was added in a quantity of 2.5 kg/to of paper atro and alkenyl succinic acid anhydride was used as sizing agent in a quantity of 0.5 kg/to paper atro. The pulp contains no fillers. The consistency of the pulp at the head box was 0.2%. Dewatering was carried out on a Foudrinier wire section and with a press section with three nips, wherein the linear pressure at the three nips was 55 kN/m, 80 kN/m and 80 kN/m. Before the still-moist paper was fed to the Clupak system, it was pre-dried in a slalom dryer section and treated in a Clupak system with a differential speed of −4.8% and finally dried.

The paper can be used as such and the paper properties described in the following table were measured with this paper. It is not necessary to note that the paper can be additionally calendered, for example, in a soft-nip or long-nip calender or can also be subjected to a coating treatment such as, for example, a dispersion coating treatment whereby the property can be varied still further. A calender treatment is carried out in the packaging paper here when this has a dry content of at least 88%, preferably at least 90%, particularly preferably at least 91%, i.e. the residual moisture is less than 12%. Furthermore, such a packaging paper can be used, for example, as a replacement for thin plastic packagings such as, for example, for foodstuffs such as muesli bars.

The paper thus produced has the following properties:

| Paper property | Standard | Unit | Direction | Result |
|---|---|---|---|---|
| Grammage | ISO 536: 2019 | g/m$^2$ | | 49 |
| Tensile strength | ISO 1924-3: 2005 | kN/m | MD | 5.8 |
| Tensile strength index | ISO 1924-3: 2005 | Nm/g | MD | 118.4 |
| Tensile strength | ISO 1924-3: 2005 | kN/m | CD | 2.4 |
| Tensile strength index | ISO 1924-3: 2005 | Nm/g | CD | 49.0 |
| Strain at break | ISO 1924-3: 2005 | % | MD | 7.1 |
| Strain at break | ISO 1924-3: 2005 | % | CD | 8.8 |
| Tensile fracture work | ISO 1924-3: 2005 | J/m$^2$ | MD | 261 |
| Tensile fracture work | ISO 1924-3: 2005 | J/m$^2$ | CD | 162 |
| Air permeability Gurley | ISO 5636-5: 2013 | s | | 22.7 |
| Bendtsen roughness | ISO 8791-2: 2013 | ml/min | Top side | 1170 |
| Bendtsen roughness | ISO 8791-2: 2013 | ml/min | Underside | 740 |

-continued

| Paper property | Standard | Unit | Direction | Result |
|---|---|---|---|---|
| Puncture strength | DIN EN 14477: 2004 at 10 mm/min | N | From top side | 5.7 |
| Puncture energy | DIN EN 14477: 2004 at 10 mm/min | mJ | From top side | 2.6 |
| Puncture energy index | DIN EN 14477: 2004 at 10 mm/min | mJ · $m^2$/kg | From top side | 53.1 |
| Puncture strength | DIN EN 14477: 2004 at 10 mm/min | N | From underside | 4.4 |
| Puncture energy | DIN EN 14477: 2004 at 10 mm/min | mJ | From underside | 1.8 |
| Puncture energy index | DIN EN 14477: 2004 at 10 mm/min | mJ · $m^2$/kg | From underside | 36.8 |
| Puncture energy factor | DIN EN 14477: 2004 at 10 mm/min | | From top side to underside | 1.44 |

Example 2: Manufacture of a Packaging Paper Having a Grammage of 100 g/$m^2$

Description of the Process:

An unbleached pulp was used consisting of 100% primary pulp made of soft wood having a Kappa number of 42 was firstly subjected to a high-consistency grinding with a grinding power of 220 to 240 kWh/to, wherein a degree of grinding of the pulp after a high-consistency grinding was 17° SR and then this pulp was subjected to a low-consistency grinding with a grinding power of 80 to 90 kWh/to until a degree of grinding of at least 18° SR was achieved. Adjuvants were added in the constant part of the paper machine. In this case, the pH was adjusted with aluminium sulphate to a pH of 6.8 to 7.3, cationic starch having a degree of cationization DS of 0.03 was added in a quantity of 14 kg/to of paper atro and alkenyl succinic acid anhydride was used as sizing agent in a quantity of 0.8 kg/to paper atro. Furthermore, fillers were added in a quantity of 0.3 kg/to paper atro. The consistency of the pulp at the head box was 0.25%. Dewatering was carried out on a Foudrinier wire section and with a press section with three nips, wherein the linear pressure at the three nips was 60 kN/m, 90 kN/m or 500 kN/m (in the shoe press). Before the still-moist paper was fed to the Clupak system, it was subjected to contact drying, convection drying and hot air input at 169° C., then it was pre-dried in a slalom dryer section and treated in a Clupak system with a differential speed of −7.9% and finally dried.

The paper can be used as such and the paper properties described in the following table were measured with this paper. It is not necessary to note that the paper can be additionally calendered, for example, in a soft-nip or long-nip calender or can also be subjected to a coating treatment such as, for example, a dispersion coating treatment whereby the property can be varied still further. Such a packaging paper can be used, for example, with or without additional coating to produce paper bags, for example, for the packaging of gravel or play bricks.

The paper thus produced has the following properties:

| Paper property | Standard | Unit | Direction | Result |
|---|---|---|---|---|
| Grammage | ISO 536: 2019 | g/$m^2$ | | 101 |
| Tensile strength | ISO 1924-3: 2005 | kN/m | MD | 8.4 |
| Tensile strength index | ISO 1924-3: 2005 | Nm/g | MD | 83.5 |
| Tensile strength | ISO 1924-3: 2005 | kN/m | CD | 6.4 |
| Tensile strength index | ISO 1924-3: 2005 | Nm/g | CD | 63.2 |
| Strain at break | ISO 1924-3: 2005 | % | MD | 9.4 |
| Strain at break | ISO 1924-3: 2005 | % | CD | 9.5 |
| Tensile fracture work | ISO 1924-3: 2005 | J/$m^2$ | MD | 412 |
| Tensile fracture work | ISO 1924-3: 2005 | J/$m^2$ | CD | 382 |
| Air permeability Gurley | ISO 5636-5: 2013 | s | | 16.9 |
| Bendtsen roughness | ISO 8791-2: 2013 | ml/min | Top side | 1310 |
| Bendtsen roughness | ISO 8791-2: 2013 | ml/min | Underside | 1650 |
| Puncture strength | DIN EN 14477: 2004 at 10 mm/min | N | From top side | 12.9 |
| Puncture energy | DIN EN 14477: 2004 at 10 mm/min | mJ | From top side | 6.4 |
| Puncture energy index | DIN EN 14477: 2004 at 10 mm/min | mJ · $m^2$/kg | From top side | 63.9 |
| Puncture strength | DIN EN 14477: 2004 at 10 mm/min | N | From underside | 11.5 |
| Puncture energy | DIN EN 14477: 2004 at 10 mm/min | mJ | From underside | 5.7 |
| Puncture energy index | DIN EN 14477: 2004 at 10 mm/min | mJ · $m^2$/kg | From underside | 56.4 |
| Puncture energy factor | DIN EN 14477: 2004 at 10 mm/min | | From top side to underside | 1.13 |

Example 3: Manufacture of a Packaging Paper Having a Grammage of 130 g/m$^2$

Description of the Process:

An unbleached pulp consisting of 100% primary pulp made of soft wood having a Kappa number of 41 was firstly subjected to a high-consistency grinding with a grinding power of 220 to 240 kWh/to, wherein a degree of grinding of the pulp after a high-consistency grinding was 18° SR and then this pulp was subjected to a low-consistency grinding with a grinding power of 80 to 90 kWh/to until a degree of grinding of at least 198° SR was achieved. Adjuvants were added in the constant part of the paper machine. In this case, the pH was adjusted with aluminium sulphate to a pH of 6.7 to 7.3, cationic starch having a degree of cationization DS of 0.03 was added in a quantity of 14 kg/to of paper atro and alkenyl succinic acid anhydride was used as sizing agent in a quantity of 0.8 kg/to paper atro. Furthermore, no fillers were added. The consistency of the pulp at the head box was 0.25%. Dewatering was carried out on a Foudrinier wire section and with a press section with three nips, wherein one of these can be a shoe press, wherein the linear pressure at the three nips was 60 kN/m, 90 kN/m and 500 kN/m (in the shoe press). Before the still-moist paper was fed to the Clupak system, it was subjected to contact drying, convection drying and hot air input at 172° C., then it was pre-dried in a slalom dryer section and treated in a Clupak system with a differential speed of −8.6% and finally dried.

The paper can be used as such and the paper properties described in the following table were measured with this paper. It is not necessary to note that the paper can be additionally calendered, for example, in a soft-nip or long-nip calender or can also be subjected to a coating treatment such as, for example, a dispersion coating treatment whereby the property can be varied still further. Such a packaging paper can be configured as a multilayer packaging paper, with or without additional coating and can be used as a replacement for board packagings, e.g. for foodstuffs such as rice.

The paper thus produced has the following properties:

Example 4: Manufacture of a Packaging Paper Having a Grammage of 160 g/m$^2$

Description of the Process:

An unbleached pulp was used consisting of 100% primary pulp made of soft wood having a Kappa number of 41 was firstly subjected to a high-consistency grinding with a grinding power of 240 to 250 kWh/to, wherein a degree of grinding of the pulp after a high-consistency grinding was 17° SR and then this pulp was subjected to a low-consistency grinding with a grinding power of 45 to 55 kWh/to until a degree of grinding of at least 18° SR was achieved. Adjuvants were added in the constant part of the paper machine. In this case, the pH was adjusted with aluminium sulphate to a pH of 6.6 to 7.2, cationic starch having a degree of cationization DS of 0.053 was added in a quantity of 7.3 kg/to of paper atro and alkenyl succinic acid anhydride was used as sizing agent in a quantity of 0.3 kg/to paper atro. Furthermore, fillers were added in a quantity of 0.5 kg/to paper atro. The consistency of the pulp at the head box was 0.205%. Dewatering was carried out on a Foudrinier wire section and a press section with three nips, wherein the linear pressure at the three nips was 60 kN/m, 90 kN/m and 80 kN/m. Before the still-moist paper was fed to the Clupak system, it was subjected to contact drying, convection drying and hot air input at 165° C., treated in a Clupak system with a differential speed of −10.9% and finally dried.

The paper can be used as such and the paper properties described in the following table were measured with this paper. It is not necessary to note that the paper can be additionally calendered, for example, in a soft-nip or long-nip calender or can also be subjected to a coating treatment such as, for example, a dispersion coating treatment whereby the property can be varied still further. Finally the paper can also be used, for example, as multilayer packaging paper, for example as a replacement for board packagings.

The paper thus produced has the following properties:

| Paper property | Standard | Unit | Direction | Result |
|---|---|---|---|---|
| Grammage | ISO 536: 2019 | g/m$^2$ | | 131 |
| Tensile strength | ISO 1924-3: 2005 | kN/m | MD | 10.3 |
| Tensile strength index | ISO 1924-3: 2005 | Nm/g | MD | 78.6 |
| Tensile strength | ISO 1924-3: 2005 | kN/m | CD | 8.2 |
| Tensile strength index | ISO 1924-3: 2005 | Nm/g | CD | 62.6 |
| Strain at break | ISO 1924-3: 2005 | % | MD | 10.3 |
| Strain at break | ISO 1924-3: 2005 | % | CD | 9.7 |
| Tensile fracture work | ISO 1924-3: 2005 | J/m$^2$ | MD | 566 |
| Tensile fracture work | ISO 1924-3: 2005 | J/m$^2$ | CD | 497 |
| Air permeability Gurley | ISO 5636-5: 2013 | s | | 28.6 |
| Bendtsen roughness | ISO 8791-2: 2013 | ml/min | Top side | 1420 |
| Bendtsen roughness | ISO 8791-2: 2013 | ml/min | Underside | 1890 |
| Puncture strength | DIN EN 14477: 2004 at 10 mm/min | N | From top | 14.5 |
| Puncture energy | DIN EN 14477: 2004 at 10 mm/min | mJ | From top | 7.0 |
| Puncture energy index | DIN EN 14477: 2004 at 10 mm/min | mJ · m$^2$/kg | From top | 53.5 |
| Puncture strength | DIN EN 14477: 2004 at 10 mm/min | N | From underside | 13.6 |
| Puncture energy | DIN EN 14477: 2004 at 10 mm/min | mJ | From underside | 6.4 |
| Puncture energy index | DIN EN 14477: 2004 at 10 mm/min | mJ · m$^2$/kg | From underside | 48.9 |
| Puncture energy factor | DIN EN 14477: 2004 at 10 mm/min | | From top side to underside | 1.09 |

| Paper property | Standard | Unit | Direction | Result |
|---|---|---|---|---|
| Grammage | ISO 536: 2019 | $g/m^2$ | | 160 |
| Tensile strength | ISO 1924-3: 2005 | kN/m | MD | 18.7 |
| Tensile strength index | ISO 1924-3: 2005 | Nm/g | MD | 116.9 |
| Tensile strength | ISO 1924-3: 2005 | kN/m | CD | 7.9 |
| Tensile strength index | ISO 1924-3: 2005 | Nm/g | CD | 49.4 |
| Strain at break | ISO 1924-3: 2005 | % | MD | 13.1 |
| Strain at break | ISO 1924-3: 2005 | % | CD | 9.3 |
| Tensile fracture work | ISO 1924-3: 2005 | $J/m^2$ | MD | 1140 |
| Tensile fracture work | ISO 1924-3: 2005 | $J/m^2$ | CD | 520 |
| Air permeability Gurley | ISO 5636-5: 2013 | s | | 31.2 |
| Bendtsen roughness | ISO 8791-2: 2013 | ml/min | Top side | 4980 |
| Bendtsen roughness | ISO 8791-2: 2013 | ml/min | Underside | 4420 |
| Puncture strength | DIN EN 14477: 2004 at 10 mm/min | N | From top side | 17.2 |
| Puncture energy | DIN EN 14477: 2004 at 10 mm/min | mJ | From top side | 10.1 |
| Puncture energy index | DIN EN 14477: 2004 at 10 mm/min | $mJ \cdot m^2/kg$ | From top side | 63.2 |
| Puncture strength | DIN EN 14477: 2004 at 10 mm/min | N | From underside | 15.7 |
| Puncture energy | DIN EN 14477: 2004 at 10 mm/min | mJ | From underside | 8.7 |
| Puncture energy index | DIN EN 14477: 2004 at 10 mm/min | $mJ \cdot m^2/kg$ | From underside | 54.4 |
| Puncture energy factor | DIN EN 14477: 2004 at 10 mm/min | | From top side to underside | 1.161 |

All the tests on papers and all the values were carried out/determined under test conditions in accordance with ISO 187:1990 (23° C.±1° C. and 50%±2% relative air humidity). It is obviously known to the person skilled in the art that paper is strongly influenced by climatic conditions and in particular its properties may vary in a moist or warm environment or also in extremely cold and dry environment. The packaging papers manufactured and tested in connection with the present invention only showed a reduction of about 5% with regard to the puncture energy at 75% relative humidity compared to the value at 50% relative humidity so that the packaging papers can be used even under harsh climatic conditions, in particular high humidities for packaging almost any sharp-edged objects or products having an uneven surface. This is attributable inter alia to the relatively high starch content of the packaging papers and also to the Clupak and/or high-consistency treatments.

The invention claimed is:

1. Packaging paper for sharp-edged objects and/or objects which have non-uniformly arranged, protruding, substantially non-deformable elevations on at least one of its surfaces, which consists of kraft pulp as main constituent as well as fillers, starch, sizing agents and further process adjuvants as well as bleaching agents and/or coating agents, wherein it contains at least 95% primary pulp which contain at least 80%, pulp having an average length-weighted fibre length of at least 2.0 mm as well as less than 4.5%, fillers as well as cationic starch and other process adjuvants, it has a strain at break in the machine direction (MD) according to ISO 1924-3:2005 of at least 6.0% that it has a puncture energy index according to DIN EN 14477:2004 measured at a test speed of 10.0 mm/min on an arbitrary side of the packaging paper in the range of 30 to 75 $mJ \cdot m^2/kg$ and it has a Kappa number ISO 302:2015 between 35 and 58.

2. The packaging paper according to claim 1, wherein it contains 100% primary pulp.

3. The packaging paper according to claim 1, wherein the primary pulp consists of a mixture consisting of at least 80% soft wood pulp, with an average length-weighted fibre length according to ISO 16065-2:2014 of at least 2.1 mm as well as remainder hard wood pulp having an average length-weighted fibre length according to ISO 16065-2:2014 of at least 1.0 mm.

4. The packaging paper according to claim 1, wherein the primary pulp consists of 100% soft wood pulp with an average length-weighted fibre length according to ISO 16065-2:2014 of at least 2.1 mm.

5. The packaging paper according to claim 1, wherein the grammage in accordance with ISO 536:2019 of the packaging paper is 45 $g/m^2$ to 165 $g/m^2$.

6. The packaging paper according to claim 1, wherein it has a tensile strength index in the machine direction in accordance with ISO 1924-3:2005 between 60 and 140 Nm/g.

7. The packaging paper according to claim 1, wherein the primary pulp is ground pulp having a Schopper-Riegler degree of grinding in accordance with ISO 5267-1:1999 between 13°SR to 20° SR.

8. The packaging paper according to claim 1, wherein it has a Gurley value in accordance with ISO 5636-5:2013 between 5 s and 45 s.

9. The packaging paper according to claim 1, wherein at least one side of the packaging paper is surface-treated.

10. The packaging paper according to claim 9, wherein a puncture energy index in accordance with DIN EN 14477: 2004 between a surface-treated side of the packaging paper and an untreated side of the packaging paper differs by a factor greater than 1.0 to1.7.

* * * * *